US009901517B2

(12) United States Patent
Lo

(10) Patent No.: US 9,901,517 B2
(45) Date of Patent: Feb. 27, 2018

(54) FEEDING DEVICE AND A FEEDING APPARATUS WITH SUCH FEEDING DEVICE

(71) Applicant: Swift Sino Limited, Kowloon (HK)

(72) Inventor: Fu Man Herman Lo, Kowloon (HK)

(73) Assignee: Swift Sino Limited, Kowloon (HK)

( * ) Notice: Subject to any disclaimer, the term of this patent is extended or adjusted under 35 U.S.C. 154(b) by 0 days.

(21) Appl. No.: 14/360,116

(22) PCT Filed: Jan. 20, 2014

(86) PCT No.: PCT/IB2014/058386
§ 371 (c)(1),
(2) Date: May 22, 2014

(87) PCT Pub. No.: WO2014/184686
PCT Pub. Date: Nov. 20, 2014

(65) Prior Publication Data

US 2015/0174011 A1 Jun. 25, 2015

(30) Foreign Application Priority Data

May 13, 2013 (CN) ..... 2013 1 0175125
May 13, 2013 (CN) ..... 2013 2 0257397 U

(51) Int. Cl.
*A61J 11/00* (2006.01)
*A61J 9/00* (2006.01)

(52) U.S. Cl.
CPC ..... *A61J 9/005* (2013.01); *A61J 11/0015* (2013.01); *A61J 11/0035* (2013.01)

(58) Field of Classification Search
CPC ..... A61J 11/04; A61J 11/0035; A61J 11/004
USPC ..... 215/11.1; 606/234, 236
See application file for complete search history.

(56) References Cited

U.S. PATENT DOCUMENTS 2,588,069 A * 3/1952 Allen ..... A61J 9/00 215/11.1
2,709,434 A * 5/1955 Pancoast ..... A61J 11/004 215/11.1
3,742,950 A * 7/1973 Endrody ..... A61J 17/02 215/11.1

(Continued)

FOREIGN PATENT DOCUMENTS

CN 2527277 12/2002
CN 201324385 10/2009

(Continued)

*Primary Examiner* — Sue A Weaver
(74) *Attorney, Agent, or Firm* — Howson & Howson LLP

(57) ABSTRACT

This invention is relating to a feeding device and a feeding apparatus with such feeding device. Wherein, the feeding device, which is made of soft resilient material, includes a circular base and a sac formed by extended down from the circular base. At the end of the said sac there are one or more apertures. The said sac includes a collapsible annular part. The feeding apparatus includes the said feeding device. Since this inventive feeding device includes a collapsible annular part, it enlarges the space of the sac in one hand; on the other hand, it may function as a pump to make it easier to extrude food from the sac and more feasible for the food feeding. Furthermore, the collapsible part may be bent to an angle, which promotes the ease of use and practicality.

4 Claims, 13 Drawing Sheets

(56) References Cited

U.S. PATENT DOCUMENTS

| | | | | | |
|---|---|---|---|---|---|
| 4,192,307 | A * | 3/1980 | Baer | A61J 17/006 | 215/11.1 |
| 4,505,398 | A * | 3/1985 | Kesselring | A61J 11/0035 | 215/11.5 |
| 5,190,174 | A | 3/1993 | Klag | | |
| 5,395,392 | A * | 3/1995 | Suhonen | A61J 7/0046 | 604/77 |
| D384,748 | S * | 10/1997 | Dunn | D24/196 | |
| 6,454,788 | B1 * | 9/2002 | Ashton | A61J 17/006 | 606/234 |
| 8,597,235 | B2 | 12/2013 | Lo | | |
| D714,950 | S * | 10/2014 | Lo | D24/194 | |
| 2003/0089676 | A1 * | 5/2003 | Uehara | A61J 11/006 | 215/11.1 |
| 2008/0210655 | A1 * | 9/2008 | Rees | A61J 11/006 | 215/11.5 |
| 2009/0062855 | A1 * | 3/2009 | Lemery | A61M 16/06 | 606/236 |

FOREIGN PATENT DOCUMENTS

| | | | | |
|---|---|---|---|---|
| CN | 102348447 | A | | 2/2012 |
| GB | 317671 | | | 8/1929 |
| JP | 3012163 | A | * | 1/1991 |
| JP | 3159462 | U | | 5/2010 |
| KR | 86014439 | U | | 12/1986 |

* cited by examiner

FEEDING DEVICE AND A FEEDING APPARATUS WITH SUCH FEEDING DEVICE

TECHNICAL FIELD

This invention is relating to a feeding device and a feeding apparatus with such feeding device.

BACKGROUND

Milk Bottles are used to contain liquid state food such as milk or beverage for feeding infants and other person of inconvenience for food, such as disabled, elderly, or patients. But, when take pieces of fruit such as pear, apple etc or vegetable, jellies yogurt and minced meat, this kind of milk bottle is not feasible. So it is in needed to develop a new feeding device for the inconvenient and/or baby to take such kind of foods.

SUMMARY

This invention tries to solve the above drawbacks of the prior arts. It provided a feeding device to make it more convenient for the infant or those inconvenient persons to take foods.

One embodiment provided in this invention to solve the said problem is: Develop a feeding device made of a soft resilient material, which includes a circular base and a sac formed by extended down from the circular base, at the end of the said sac there are one or more apertures. It is characterized that the said sac includes a collapsible part.

In one embodiment of the said feeding device in this invention, the said collapsible part is located at the end of sac near to circular base.

In one embodiment of the said feeding device in this invention, the said collapsible part (22) is in gradual contraction shape from top to bottom.

In one embodiment of the said feeding device in this invention, the said collapsible part includes a plurality of spaced apart annular protrusions and annular recesses.

In one embodiment of the said feeding device in this invention, the thickness of the said protrusion of the sac is more than that of the said recess of the sac.

In one embodiment of the said feeding device in this invention, the cross-section of the said recess is arc-shaped.

In one embodiment of the said feeding device in this invention, the cross-section of the said recess is wedge-shaped.

In one embodiment of the said feeding device in this invention, the said collapsible part includes three or four annular recesses and three or four annular protrusions spaced apart by the said recesses.

In one embodiment of the said feeding device in this invention, the thickness of the said recess (222) of the said sac (2) is from 0.4 to 0.7 times of that of other part of the sac.

In one embodiment of the said feeding device in this invention, further includes a connection part extended up from the said circular base.

In one embodiment of the said feeding device in this invention, the said connection part includes a circular connection piece, a circular groove is formed between the said circular connection piece and the said circular base.

In one embodiment of the said feeding device in this invention, the outer peripheral of the said circular connection piece has notch for positioning.

In one embodiment of the said feeding device in this invention, the feeding device is made of transparent or translucent resilient material of food grade.

In one embodiment of the said feeding device in this invention, the feeding device is made of colored or colorless resilient material of food grade.

One embodiment of this invention also provides a feeding apparatus, which includes the feeding device said above.

The implementation of this inventive feeding device and feeding apparatus has the following advantageous effects: Since the sac of the feeding device includes collapsible part, in one aspect, the sac can contain more food, in the other hand, the collapsible part can function as a pump to make it easier to extrude food from the sac and more feasible for the food feeding. Furthermore, the collapsible part may be bent to an angle, which promotes the usability and practicality.

BRIEF DESCRIPTION OF THE DRAWINGS

Specific embodiment of this invention will now be described by way of example with reference to the accompanying drawings wherein.

DETAILED DESCRIPTION

Figure 1:
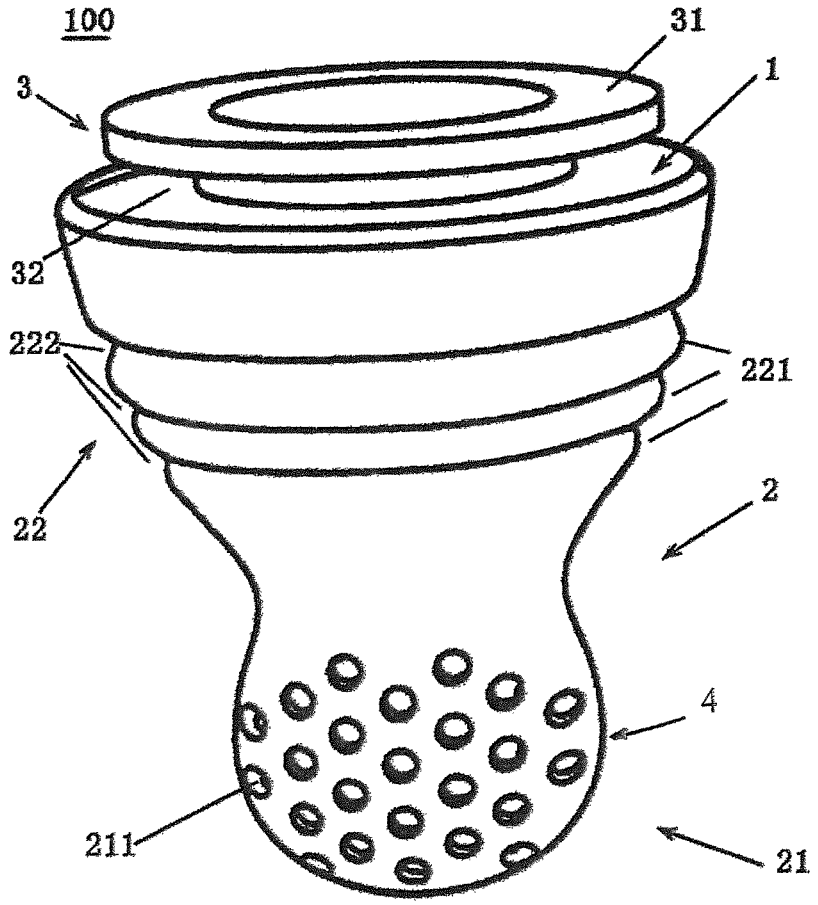
FIG. 1 is the perspective view of the first embodiment of the feeding device.
Figure 2:
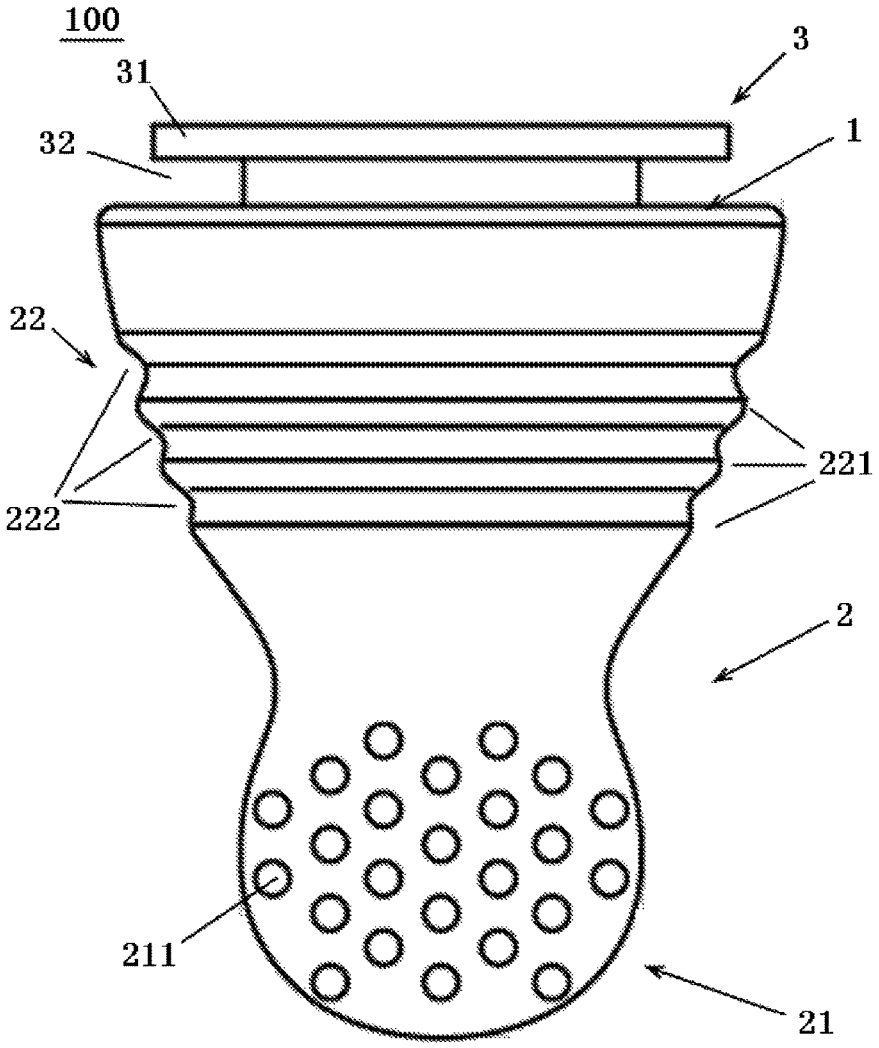
FIG. 2 is the front view of the first embodiment of the feeding device.
Figure 3:
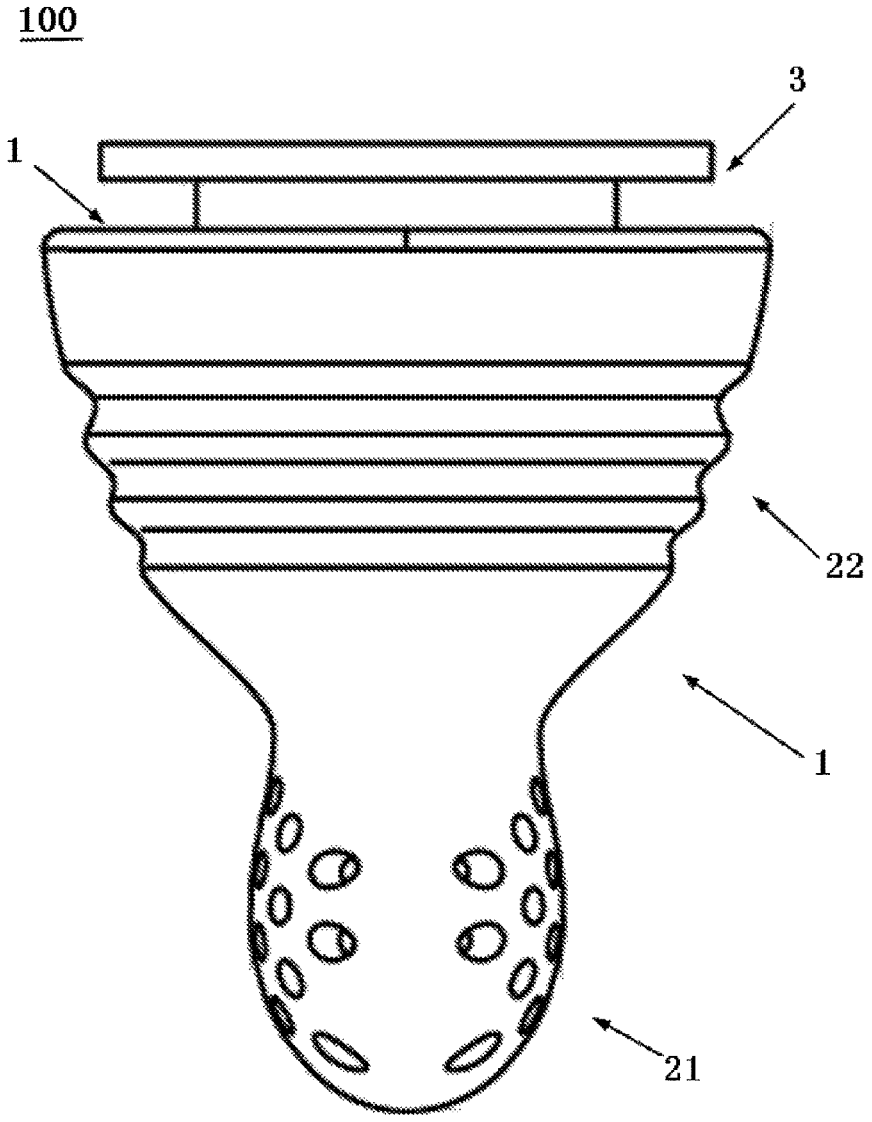
FIG. 3 is the left view of the first embodiment of the feeding device.

To make it clearer and easier to understand the features, this invention is described in more detail about the selected embodiments referring to the drawings.

FIG. 1 to FIG. 5, show the first embodiment of the feeding device of this invention. The feeding device is an infant feeding device 100, which is made of food grade resilient material such as silicon, plastic, rubber or other food grade resilient materials. The feeding device may be transparent or translucent. It also may be with color or without color. The feeding device 100 includes a circular base 1 and a sac 2 extending down from the said circular base 1. The sac 2 can be used to store food and for feeding a baby. Food is placed into the sac 2 through the open end of the circular base 1, and the sac can then be closed by a closure, e.g., elements 200 and 400 as in FIGS. 13-15. The sac 2, the sac 2 includes a bulbous end portion 21 having a maximum diameter at an intermediate location 4. For the feasibility of feeding via the sac 2, the bulbous end portion 21 is provided with a plurality of apertures 211 for the passage of food from the interior to the exterior of the bulbous end portion. These apertures include apertures above said intermediate location of the maximum diameter of the bulbous end Portion and apertures below said intermediate location of the maximum diameter of the bulbous end portion. The apertures 211 may be in any shape. To comfort and pacify the baby teeth, the sac may be set one or more protrusions (not shown) beside the apertures 211 or between apertures 211.

The sac 2 of the said feeding device 100 includes a collapsible part 22. The said collapsible part 22 is located at the end of sac 2 near to circular base 1 as one preferable embodiment. the said collapsible part 22 includes a plurality of spaced apart annular protrusions 221 and annular recesses 222. The said collapsible part 22 may be collapsed with extra force due to the design of plurality of spaced apart annular protrusions 221 and annular recesses 222 and the resilient material used. That is, the said annular recesses 222 are compressed and the said annular protrusions 221 are folded together.

To make the said collapsible part 22 easier to be folded, preferably, the thickness of the said annular protrusions 221 on the sac 2 may be thicker than that of the said annular recesses 222. It can be understandable that the thickness of the said annular protrusions 221 is same as that of the said annular recesses 222.

In this example instance, the thickness of the said annular recesses 222 of the collapsible part 22 is about from 0.4 to 0.7 times of that of other part of the sac 2 except the collapsible part 22. For example, the thickness of the sac is 1.2 mm, then the thickness of the said annular recesses 222 is 0.6 mm or 0.8 min or other like value.

In this example instance, the feeding device 100 is a three-folding feeding device. The collapsible part 22 of the sac 2 contains three spaced apart annular protrusions 221 and three annular recesses 222. The cross-section shape of the annular recesses 222 may be in arc shape or in wedge shape. As showed in FIG. 4, the cross-section shape of the annular recesses 222 is in arc shape. As showed in FIG. 5, the cross-section shape of the annular recesses 222' is in wedge shape. That is the annular recess 222' is angular.

Figure 4:
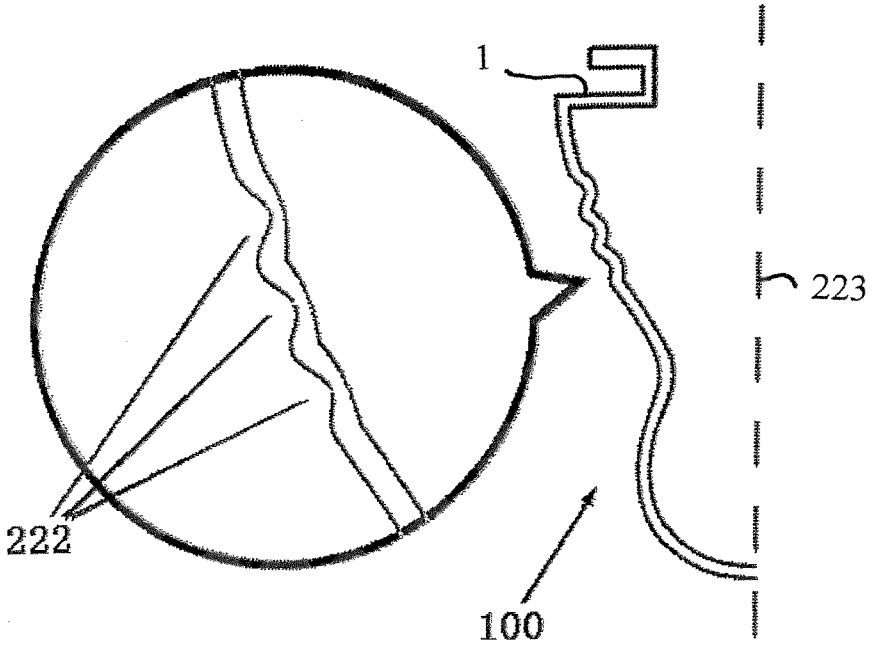
FIG. 4 is one type of partially cross-section view of the first embodiment of the feeding device.
Figure 5:
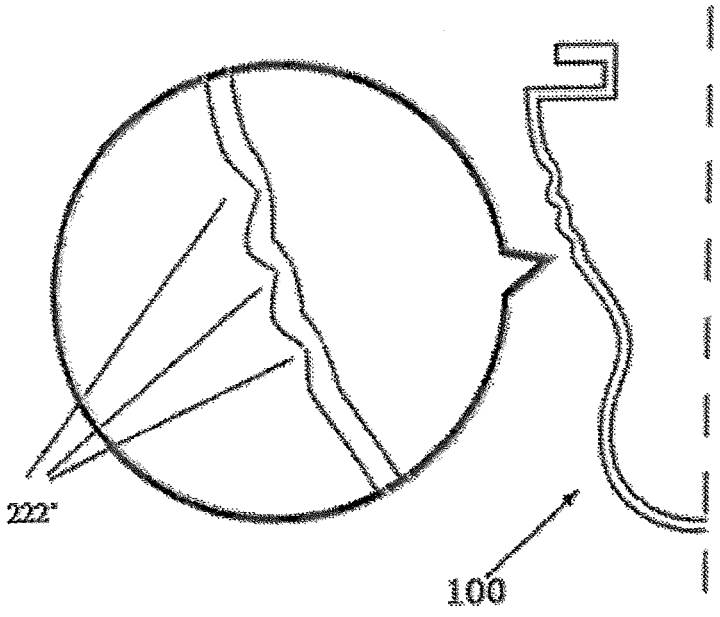
FIG. 5 is another type of partially cross-section view of the first embodiment of the feeding device.
Figure 6:
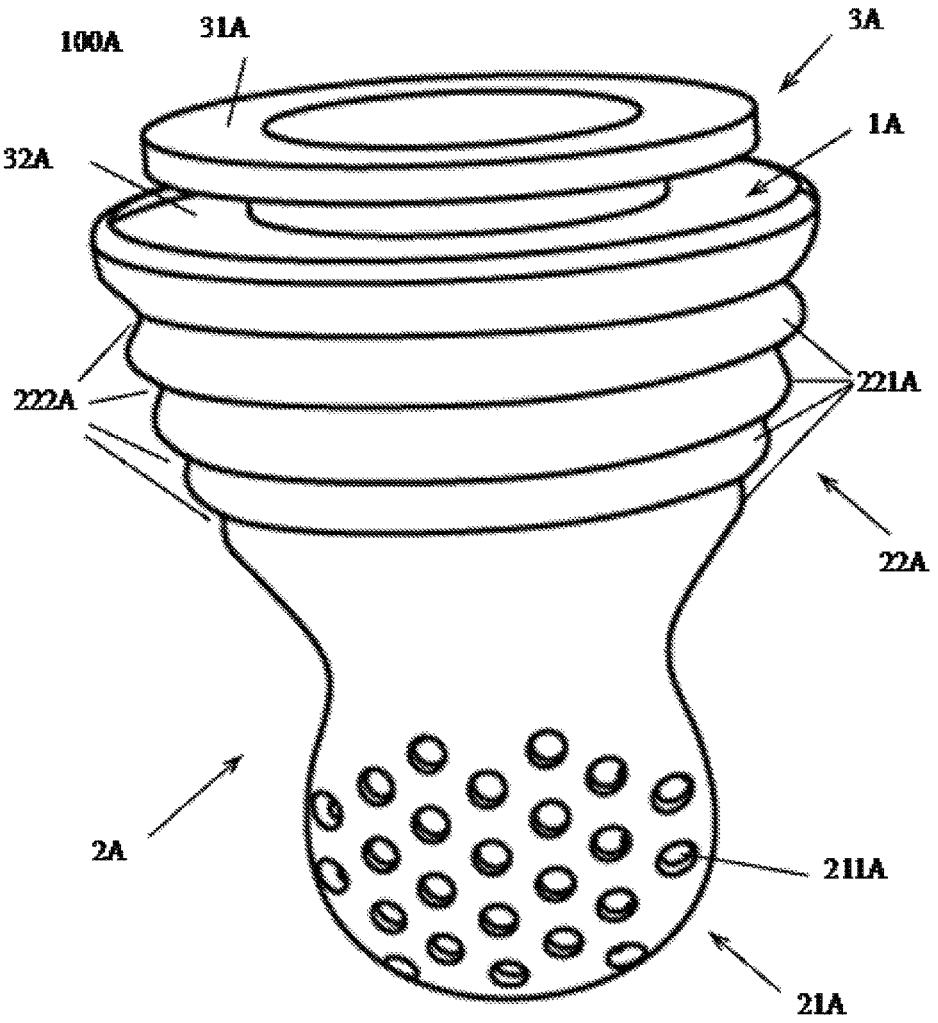
FIG. 6 is the perspective view of the second embodiment of the feeding device.
Figure 7:
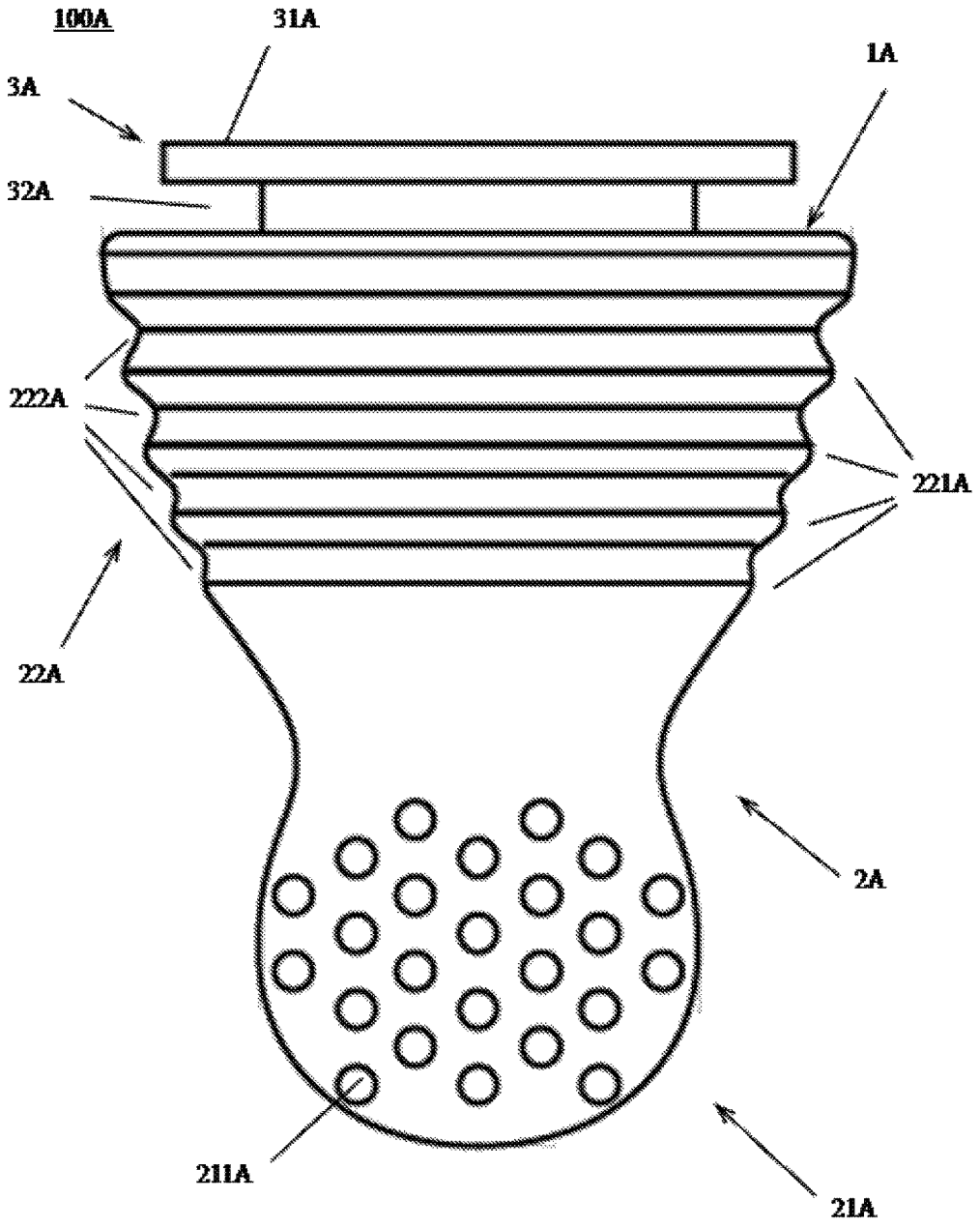
FIG. 7 is the front view of the second embodiment of the feeding device.
Figure 8:
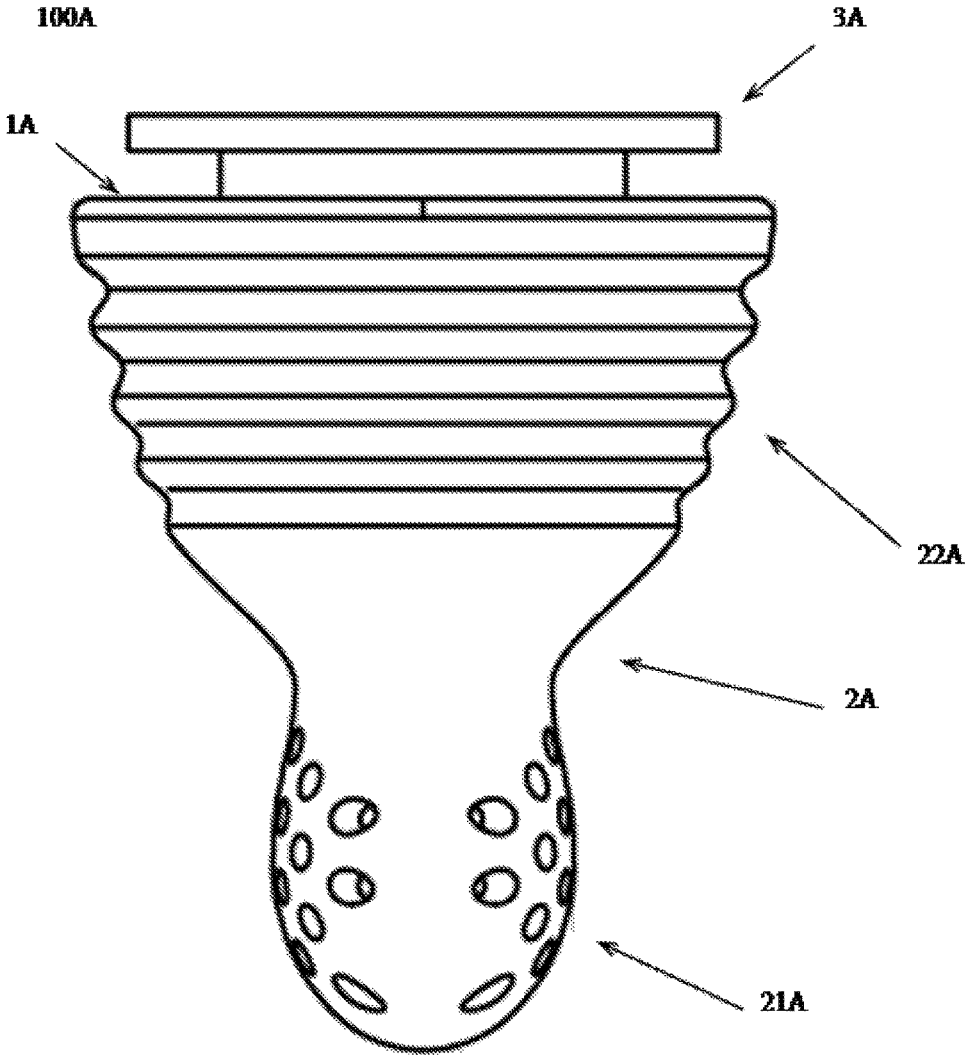
FIG. 8 is the left view of the second embodiment of the feeding device.
Figure 9:
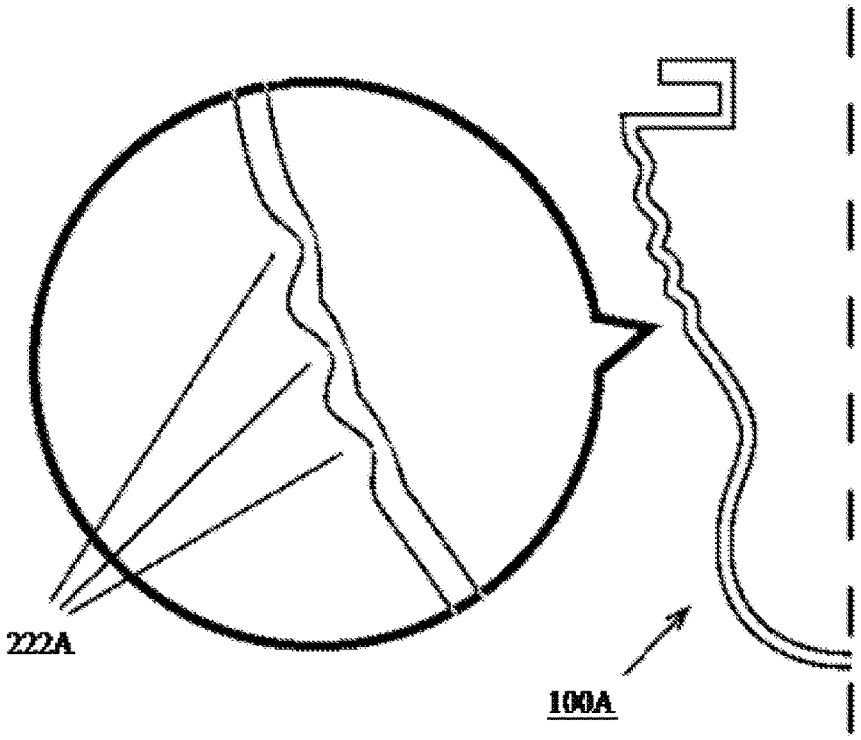
FIG. 9 is one type of partially cross-section view of the second embodiment of the feeding device.
Figure 10:
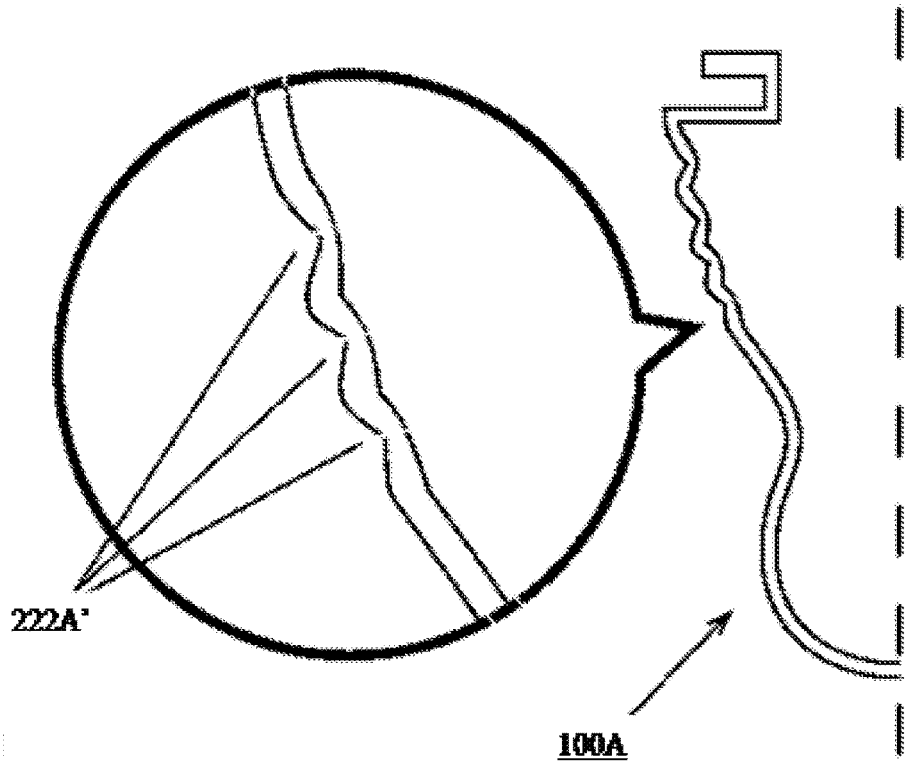
FIG. 10 is another type of partially cross-section view of the first embodiment of the feeding device.

As shown in FIG. 4, the spaced apart annular protrusions 221 are in alternating relationship with at least three spaced apart annular recesses 222. The annular protrusions and annular recesses are disposed in a series and in symmetrical relationship to a common axis 223. Each of the annular recesses of the sac, except for an annular recess closest to the circular base 1, is axially farther than a next preceding annular recess in the series from the circular base, with reference to the common axis 223.

With the collapsible part 22, in the one hand, the volume of the sac 2 is enlarged to store more food in it; on the other hand, the collapsible part 22 may function as pump so the user is easier to squeeze the food out for feeding. Furthermore, the collapsible part 22 may bend an angle to improve the usability and practicability. In this embodiment, the said collapsible part 22 is in gradual contraction shape from top to bottom. To be understandable, the said collapsible part 22 may be other type of shape, such as cylindrical shape from top to bottom.

This inventive feeding device may be used independently. It may also be integrated with other parts to form a feeding apparatus. To make the feeding device 100 feasible to match with other parts, in this embodiment, the feeding device 100 further includes a connection part 3 extended up from the said circular base 1. The said connection part 3 includes a circular connection piece 31 and a circular groove 32 which is formed between the said circular connection piece 31 and the said circular base 1. The feeding device is then installed into the feeding apparatus with the circular connection piece 31. For example, the circular connection piece 31 may be clamped by other parts so that the feeding device is connected with other parts.

As in FIG. 6 to FIG. 10, it is the second embodiment of the feeding device of this invention. The feeding device 100A is a four-folding feeding device. The structure of feeding device 100A is similar to that of feeding device 100 in the first embodiment except the collapsible part 22A of the sac 2A contains four spaced apart annular protrusions 221A and three annular recesses 222A. There is no repeat here. As showed in FIG. 9, the cross-section shape of the annular recesses 222A is in arc shape. As showed in FIG. 10, the cross-section shape of the annular recesses 222A' is in wedge shape. That is the annular recess 222A' is angular. Other labels in the figures are defined as: circular base 1A, sac 2A, the end 21A of the said sac 2A, apertures 211A, connection part 3A, circular connection piece 31A, and circular groove 32A.

Figure 11:
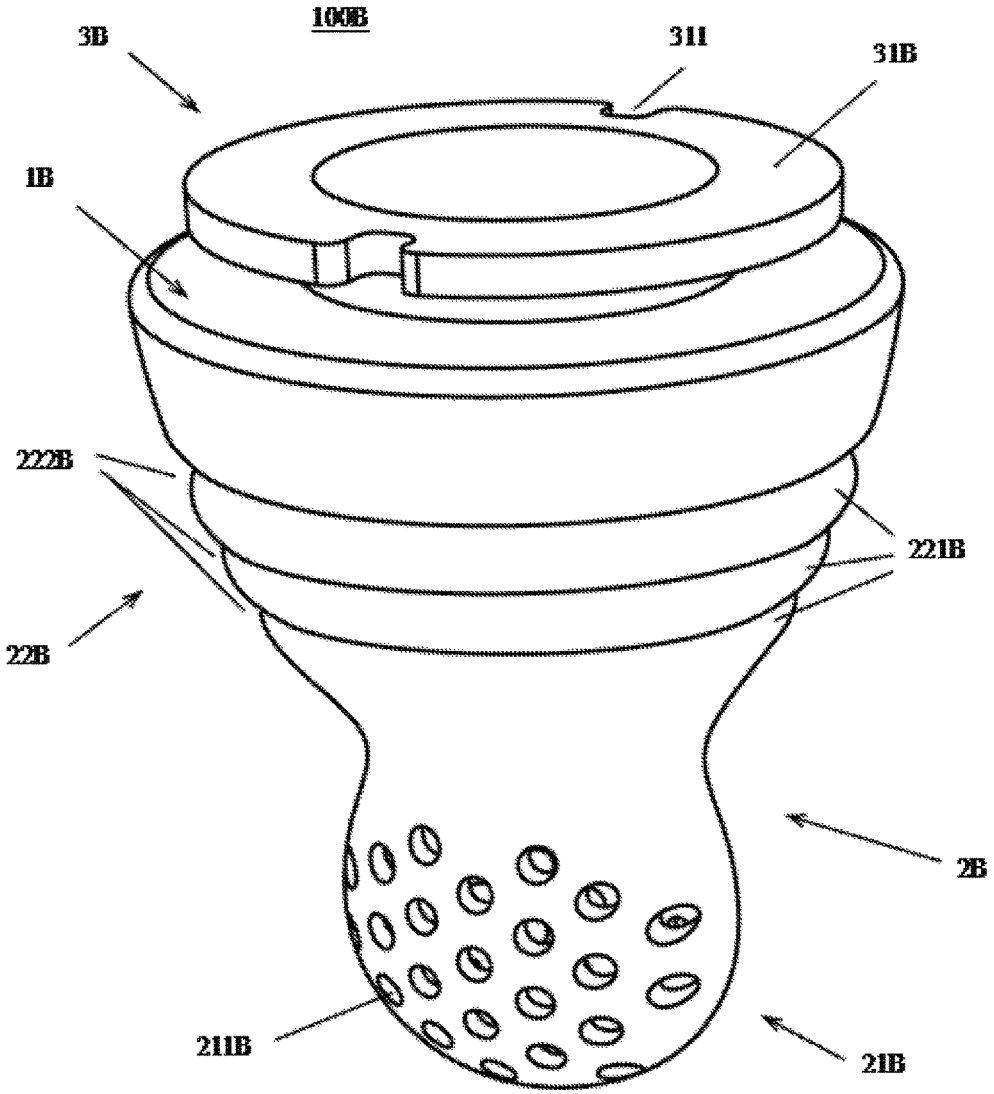
FIG. 11 is the perspective view of the third embodiment of the feeding device.
Figure 12:
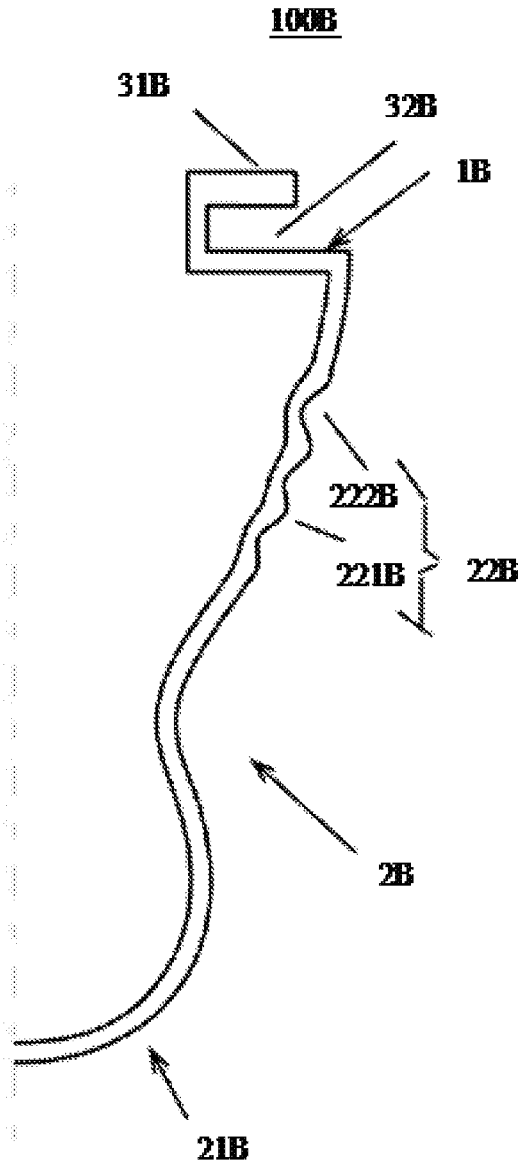
FIG. 12 is partially cross-section view of the third embodiment of the feeding device.

As in FIG. 11 to FIG. 12, it is the third embodiment of the feeding device of this invention. The structure of feeding device 100B is similar to that of feeding device 100 in the first embodiment except the structure of the circular connection piece 31B is different from that of the said circular connection piece 31 in the first embodiment. In this embodiment, the outer peripheral of the said circular connection piece 31B has two notches for quickly positioning it with other parts. There is no repeat here to describe other structures. Other labels in the figures are defined as: circular base 1B, sac 2B, the end 21B of the said sac 2B, apertures 211B, connection part 3B, circular connection piece 31B, circular groove 32B, collapsible part 22B, annular protrusions 221B and annular recesses 222B.

Figure 13:
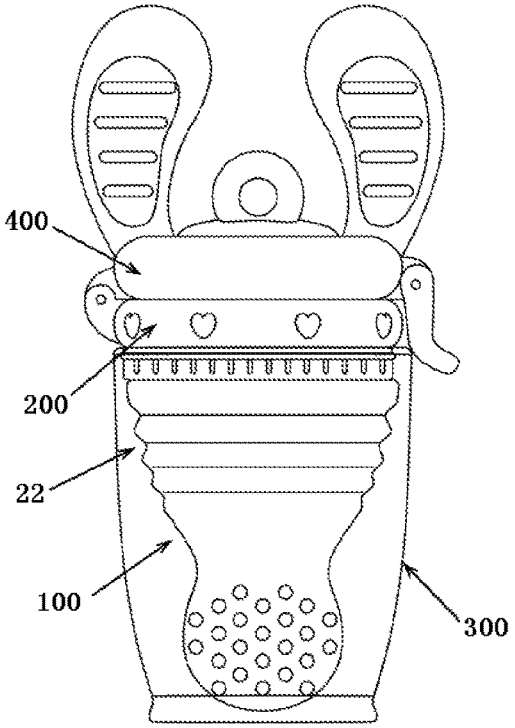
FIG. 13 is the front view of one preferred embodiment of the feeding apparatus.
Figure 14:
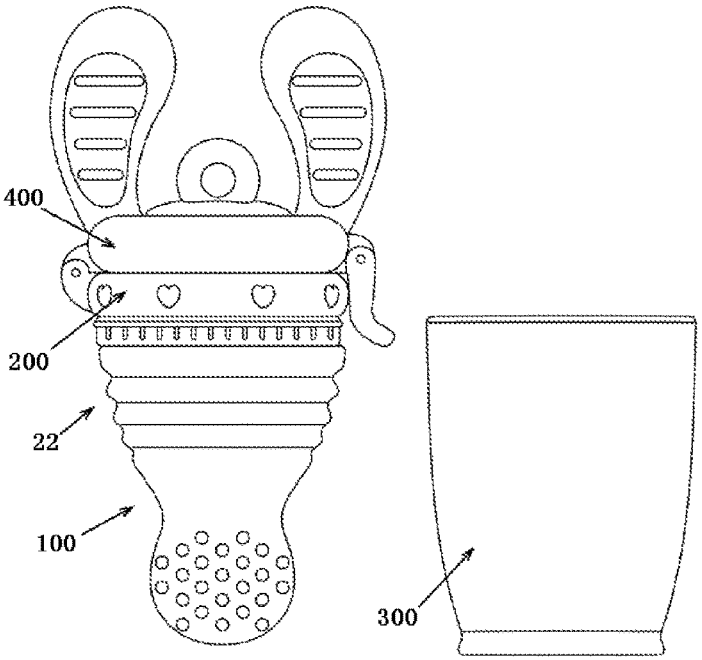
FIG. 14 is the diagram without outer cover of feeding apparatus as showed in FIG. 13.
Figure 15:
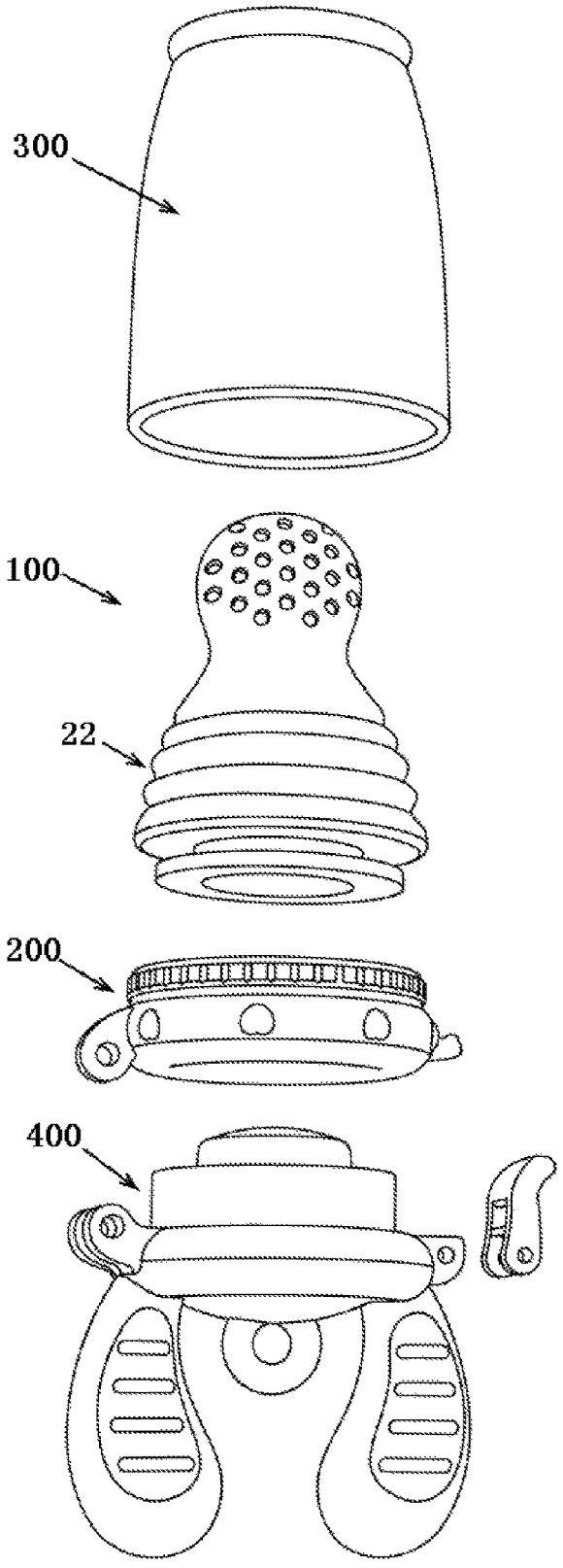
FIG. 15 is the exploded view of feeding apparatus as showed in FIG. 13.
Figure 16A:
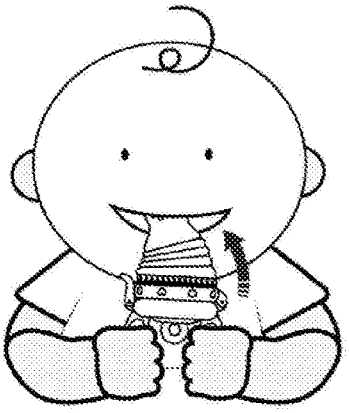
FIG. 16*a*-16*d* shows the bent status of the feeding device during feeding food.
Figure 16B:
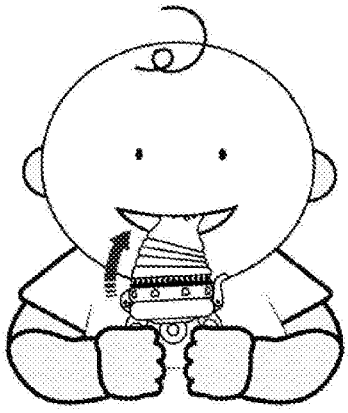
Figure 16C:
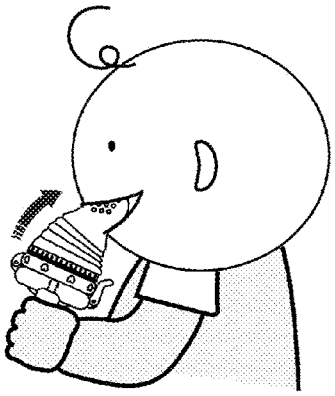
Figure 16D:
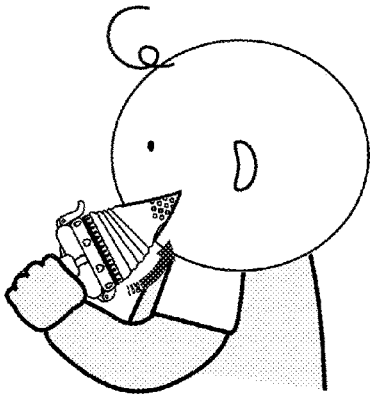
Figure 17A:
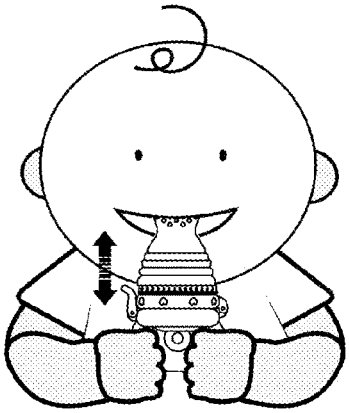
FIG. 17*a*-17*b* shows the pump function status of the feeding device during feeding food.
Figure 17B:
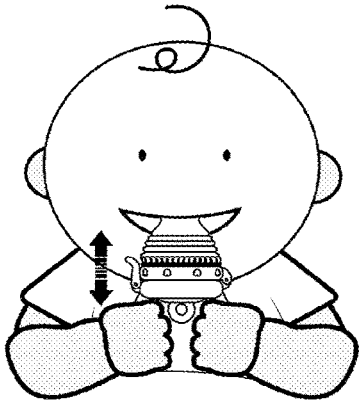

As in FIG. 13 to FIG. 15, it is one preferred embodiment of the feeding apparatus of this invention. In this embodiment, it includes any one of the above said feeding device 100, 100A or 100B. As example, here refer to feeding device 100. As in the figures, the feeding apparatus includes the first connection element 200 to connect with feeding device 100, and a cover 300 to cover the feeding device 100. The first connection element 200 is hinged with a second connection element 400. The second connection element 400 is hinged with the connection element 200 at one side and is fastened with the connection element 200 on the other side. The second connection element 400 may include handler for user to handle.

As showed from FIG. 16*a* to FIG. 16*d*, it showed that a infant feeds himself with the feeding device. The collapsible part 22 of the feeding device 100 can be bent an angle to improve the usability and practicability. Although the baby head rotate of do other movement relative to the feeding device, the collapsible part 22 of the feeding device 100 will bend an angle to follow the relative movement between the baby head and the feeding device 100. As showed from FIG. 16*a* to FIG. 16*d*, the feeding device can bend at any direction so that the feeding device 100 won't elapse from the baby's mouth for the relative movement between the baby head and the feeding device 100.

As showed from FIG. 16*a* to FIG. 16*d*, the collapsible part 22 of the feeding device function as pump. As showed in the figures, the collapsible part 22 is stretched at first, and then it is squashed. The volume in the feeding device changes in this way so that user is easier to squeeze the food for feeding.

Furthermore, since the sac of the feeding device includes collapsible part, in one aspect, the sac can contain more food. The volume of the sac can be adaptable. For example, when the baby is younger, the foldable part can be folded so as to reduce the volume. With the grown up of the baby, the foldable part can be stretched out to enlarge the volume. So this inventive feeding device is adaptable to meet the requirements of baby feeding during his growing up. No need to replace the feeding device in the period of baby's growing up.

Other than used by the baby, the above said feeding device and feeding apparatus are also used by the inconvenient person for feeding himself, such as the disabled, elderly or sick person. These persons can feed themselves by chewing and sucking the sac. Also this inventive products can also be used in the weightless space environment.

The above description described some embodiments of this invention. But this invention is not limited to the above embodiments. These embodiments are for example only without limited the concept of this invention. For the ordinary person in this industry, it can make many other embodiments based on the concept of this invention, which are all within the scope of this invention and are protected by this invention.

The invention claimed is:

1. A feeding device, comprising a circular base, a sac extending downward from said circular base, and a closure, engageable with said base, and forming, with said sac and base, a container having an interior space capable of holding a semi-solid food, said sac being made of resilient material and having a bulbous end portion of a size suitable for reception into an infant's mouth, said end portion having a maximum diameter at an intermediate location between an upper end thereof and a lower end thereof and a plurality of apertures for passage of food from the interior of said sac to the exterior of said end portion, said apertures including apertures below said intermediate location and apertures above said intermediate location, wherein;

said sac includes an annular wall extending from said circular base to said end portion, said wall having a tapered profile with a larger diameter end adjacent said circular base and a smaller diameter end adjacent said bulbous end portion of the sac, and including, between said circular base and said end portion, a collapsible part, the collapse of which reduces the volume of said interior space and results in the pumping of semi-solid food outward from said interior space through said apertures;

said collapsible part includes a plurality of spaced apart annular protrusions in alternating relationship with at least three spaced apart annular recesses, said annular protrusions and said annular recesses being disposed in a series and in symmetrical relationship to a common axis, each of the annular recesses of the sac, except for an annular recess closest to said circular base, being axially farther than a next preceding annular recess in said series from said circular base, with reference to the direction of said common axis;

said annular protrusions being progressively larger in diameter, proceeding in a direction from said end portion to said base, and said annular recesses also being progressively larger in diameter, proceeding in a direction from said end portion to said base;

the thicknesses of said protrusions is greater than the thicknesses of said recesses; and the cross-sections of the said recesses are arc-shaped or wedge-shaped.

2. The feeding device according to claim 1, in which the thickness of said annular recesses is from 0.4 to 0.7 times the thickness of the other parts of the sac.

3. The feeding device according to claim 1, in which the cross-sections of said recesses are arc-shaped.

4. The feeding device according to claim 1, in which the cross-sections of the recesses are wedge-shaped.

* * * * *